US007727691B2

(12) United States Patent
Miki et al.

(10) Patent No.: US 7,727,691 B2
(45) **Date of Patent: *Jun. 1, 2010**

(54) ELECTROPHOTOGRAPHIC PHOTOSENSITIVE MEMBER, PROCESS CARTRIDGE AND ELECTROPHOTOGRAPHIC APPARATUS

(75) Inventors: Nobumichi Miki, Shizuoka-ken (JP); Hideaki Nagasaka, Shizuoka-ken (JP); Michiyo Sekiya, Shizuoka-ken (JP); Kunihiko Sekido, Shizuoka-ken (JP); Yosuke Morikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/398,546

(22) Filed: Mar. 5, 2009

(65) Prior Publication Data

US 2009/0185822 A1 Jul. 23, 2009

Related U.S. Application Data

(62) Division of application No. 11/103,627, filed on Apr. 12, 2005, now Pat. No. 7,534,537.

(51) Int. Cl.
*G03G 5/14* (2006.01)

(52) U.S. Cl. ..... 430/63; 430/60; 399/159

(58) Field of Classification Search ..... 430/63, 430/60; 399/159
See application file for complete search history.

(56) References Cited

U.S. PATENT DOCUMENTS

| | | | | |
|---|---|---|---|---|
| 4,416,963 | A | 11/1983 | Takimoto et al. | 430/69 |
| 4,948,690 | A | 8/1990 | Hisamura et al. | 430/60 |
| 5,464,718 | A | 11/1995 | Kashizaki et al. | 430/63 |
| 5,488,461 | A | 1/1996 | Go et al. | 355/211 |
| 5,875,375 | A | 2/1999 | Ohmori et al. | 399/159 |
| 6,400,916 | B1 | 6/2002 | Go et al. | 399/111 |
| 6,541,172 | B2 | 4/2003 | Nagasaka et al. | 430/59.5 |
| 6,697,591 | B2 | 2/2004 | Morikawa et al. | 399/159 |
| 6,829,459 | B2 | 12/2004 | Tanaka et al. | 399/176 |
| 6,833,226 | B2 | 12/2004 | Takizawa et al. | 430/59.5 |
| 7,534,537 | B2 * | 5/2009 | Miki et al. | 430/63 |
| 2004/0043315 | A1 | 3/2004 | Takiguchi et al. | 430/108.6 |

FOREIGN PATENT DOCUMENTS

| | | |
|---|---|---|
| JP | 61-36755 | 2/1986 |
| JP | 61-98359 | 5/1986 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) p. 163.*

*Primary Examiner*—Christopher RoDee
(74) *Attorney, Agent, or Firm*—Fitzpatrick, Cella, Harper & Scinto

(57) ABSTRACT

An electrophotographic photosensitive member includes a conductive layer, an intermediate layer and a photosensitive layer in this order on a substrate, in which the conductive layer contains a binder resin and conductive particles. The conductive particles are $TiO_2$ particles coated with oxygen-deficient $SnO_2$, the conductive particles have an average particle size of 0.2 to 0.6 μm and the conductive layer has a volume resistivity of $5\times10^5$ to $8\times10^8$ Ω·cm. Also this invention provides a process cartridge and an electrophotographic apparatus equipped with such electrophotographic photosensitive member.

10 Claims, 1 Drawing Sheet

FOREIGN PATENT DOCUMENTS

| | | | |
|---|---|---|---|
| JP | 62-187358 | | 8/1987 |
| JP | 63-163468 | | 7/1988 |
| JP | 3-31855 | | 2/1991 |
| JP | 04-154621 | A | 5/1992 |
| JP | 06-208238 | A | 7/1994 |
| JP | 07-271072 | A | 10/1995 |
| JP | 07-295245 | A | 11/1995 |
| JP | 9-288367 | | 11/1997 |
| JP | 10-186702 | A | 7/1998 |
| JP | 2001-13705 | | 1/2001 |
| JP | 2002-107988 | | 4/2002 |
| JP | 2002-357910 | | 12/2002 |

* cited by examiner

ELECTROPHOTOGRAPHIC PHOTOSENSITIVE MEMBER, PROCESS CARTRIDGE AND ELECTROPHOTOGRAPHIC APPARATUS

This is a divisional of U.S. patent application Ser. No. 11/103,627, filed Apr. 12, 2005, now issued as U.S. Pat. No. 7,534,537 on May 19, 2009.

BACKGROUND OF THE INVENTION

1. Field of the Invention

The present invention relates to an electrophotographic photosensitive member, and a process cartridge and an electrophotographic apparatus including an electrophotographic photosensitive member.

2. Related Background Art

Recently an electrophotographic photosensitive member utilizing an organic photoconductive material (organic electrophotographic photosensitive member) is being actively developed.

An electrophotographic photosensitive member is basically constituted of a substrate, and a photosensitive layer formed on such substrate. In practice, however, various layers are often formed between the substrate and the photosensitive layer, for the purposes of covering a defect on the surface of the substrate, improving a coating property of the photosensitive layer, improving adhesion between the substrate and the photosensitive layer, protecting the photosensitive layer from electrical destruction, improving a charging property, and improving a charge injecting property from the substrate to the photosensitive layer. Therefore, for a layer provided between the substrate and the photosensitive layer, various functions are required such as a covering property, an adhesion property, mechanical strength, electroconductivity and an electrical barrier property.

The layer provided between the substrate and the photosensitive layer has been known to be following types:

(i) a resin layer not containing a conductive material;

(ii) a resin layer containing a conductive material; and (iii) a layer (i) laminated on a layer (ii) mentioned above.

The aforementioned layer (i) has a high electrical resistance as it does not contain a conductive material. Also it has to be provided with a large thickness (film thickness) in order to cover a defect on the substrate surface not subjected to a surface smoothing process.

However, the aforementioned layer (i) of a high electrical resistance, when provided with a large film thickness, results in a drawback of a high residual potential in an initial state of use and after repeated use.

Therefore, for practical use of the layer (i), it is necessary to reduce the defects on the substrate surface and to reduce the film thickness.

On the other hand, the aforementioned layer (ii), being formed by dispersing a conductive material such as conductive particles in a resin and capable of reducing the resistance of the layer, can be employed with a large film thickness thereby covering a surface defect of an electroconductive substrate or a non-conductive substrate (such as a resinous substrate).

However, in case of increasing the thickness of the aforementioned layer (ii), it is necessary, in comparison with the layer (i) which is made thinner, to provide the layer with a sufficient electrical conductivity, whereby the layer (ii) will have a low volume resistivity. For this reason, in order to avoid a charge injection from the substrate or the layer (ii) into the photosensitive layer, constituting a cause of an image defect, over wide environmental conditions from a condition of a low temperature and a low humidity to a condition of a high temperature and a high humidity, it is preferable to provide a layer having an electrical barrier property between the layer (ii) and the photosensitive layer. The layer having an electrical barrier property is, for example, a resin layer not containing conductive particles such as the aforementioned layer (i).

Stated differently, the layer provided between the substrate and the photosensitive layer preferably has an aforementioned configuration (iii), formed by lamination of the layer (i) and the layer (ii).

The configuration (iii) involves an increased number of process steps since plural layers have to be formed, but increases a tolerance for the surface defect of the substrate, thereby significantly widening the tolerance for the substrate and providing an advantage of increasing the productivity.

In general, the aforementioned layer (ii) is called a conductive layer, and the layer (i) is called an intermediate layer (undercoat layer or barrier layer).

A conductive material to be employed in the conductive layer includes various metals, metal oxides and conductive polymers. Among these, tin oxide ($SnO_2$) having excellent resistance characteristics is known as conductive materials of various types such as an ordinary compound with a powder resistivity of $10^4$-$10^6$ Ω·cm, a compound which is mixed (doped), at the manufacture of $SnO_2$ conductive material, with a compound of a metal of a valence number different from that of tin, such as antimony oxide or a non-metal element for reducing the powder resistivity to 1/1000-1/100,000, and a non-doped oxygen-deficient $SnO_2$ in which the resistance of $SnO_2$ is reduced to a case of antimony doping without increasing the constituent elements.

As a prior technology relating to the oxygen-deficient $SnO_2$, Japanese Patent Application Laid-Open No. H07-295245 discloses a technology of employing the oxygen-deficient $SnO_2$ in the conductive layer, also Japanese Patent Application Laid-Open No. H06-208238 discloses a technology of coating barium sulfate particles with oxygen-deficient $SnO_2$ for improving the dispersibility in comparison with a case of employing $SnO_2$ only, and Japanese Patent Application Laid-Open No. H10-186702, though not disclosing an embodiment of oxygen-deficient $SnO_2$, discloses a technology of employing barium sulfate particles for improving the dispersibility, coating titanium oxide ($TiO_2$) thereon for improving the whiteness, and further coating $SnO_2$ thereon for providing the electric conductivity.

Also because of a recent improvement in the charging uniformity of a charging apparatus, the necessity for charge pre-elimination means (such as a pre-exposure apparatus) for preventing a charging unevenness from an output image is decreasing, and there is being requested an electrophotographic apparatus of a configuration without such charge pre-elimination means in view of space saving and cost reduction.

However, in case the charge pre-elimination means such as the pre-exposure apparatus is dispensed with, a ghost image of a rotation cycle of the electrophotographic photosensitive member (a phenomenon in which an exposure hysteresis (such as a solid black image) in a one-rotation-preceding cycle of the electrophotographic photosensitive member appears on halftone image) becomes conspicuous.

The cause for such ghost phenomenon is considered the stagnation in the flow of charges (carriers) in the formation of an electrostatic latent image on the electrophotographic photosensitive member, and, in a configuration including a conductive layer, the flow of charge (carriers) tends to become stagnant because of a larger number of layers in comparison with a configuration without the conductive layer.

As it is possible, up to now, to substantially eliminate the ghost phenomenon by providing the charge pre-elimination means such as the pre-exposure apparatus and by uniformly reducing the surface potential of the electrophotographic photosensitive member before charging, the ghost phenomenon has little been raised as a technical issue. Stated differently, a fact that the ghost phenomenon becomes conspicuous in the configuration without the charge pre-elimination means such as the pre-exposure apparatus is found only recently.

As a prior technology for improving the ghost phenomenon by the structure of the conductive layer, Japanese Patent Application Laid-Open No. H07-271072 discloses a technology of employing a conductive material formed by $TiO_2$ particles coated with $SnO_2$ of which powder resistivity is reduced by antimony oxide doping and increasing a content of the conductive material in order to achieve a smooth flow of the charge (carriers) in the conductive layer.

However, the technology disclosed in Japanese Patent Application Laid-Open No. H07-271072, requiring an element antimony in addition to tin for coating the $TiO_2$ particles, has a poor reuse property, and a technology utilizing oxygen-deficient $SnO_2$, superior in the reuse property, is being expected.

SUMMARY OF THE INVENTION

An object of the present invention is to provide an electrophotographic photosensitive member capable of suppressing a ghost phenomenon, even in a configuration having a conductive layer, an intermediate layer and a photosensitive layer in succession in this order on a substrate for covering a defect on the surface of the substrate, for improving a coating property of the photosensitive layer, for improving an adhesion between the substrate and the photosensitive layer, for protecting the photosensitive layer from an electrical destruction, for improving a charging property, and for improving a charge injecting property from the substrate to the photosensitive layer, by means of oxygen-deficient $SnO_2$ having an excellent reuse property.

Another object of the present invention is to provide a process cartridge and an electrophotographic apparatus provided with such electrophotographic photosensitive member.

The present invention provides an electrophotographic photosensitive member which includes a conductive layer, an intermediate layer and a photosensitive layer in this order on a substrate and in which the conductive layer contains a binder resin and conductive particles, wherein:

the conductive particles are $TiO_2$ particles coated with oxygen-deficient $SnO_2$;

the conductive particles have an average particle size of 0.2-0.6 μm; and the conductive layer has a volume resistivity of $5\times10^5$-$8\times10^8$ Ω·cm.

The present invention also provides a process cartridge integrally supporting the aforementioned electrophotographic photosensitive member and at least one selected from the group of charging means for charging a surface of the electrophotographic photosensitive member, developing means for developing an electrostatic latent image on the surface of the electrophotographic photosensitive member with a toner to form a toner image, transfer means for transferring the toner image on the surface of the electrophotographic photosensitive member onto a transfer material, and cleaning means for cleaning a toner remaining on the surface of the electrophotographic photosensitive member, and rendered detachably mountable on a main body of an electrophotographic apparatus.

The present invention also provides an electrophotographic apparatus including the aforementioned electrophotographic photosensitive member, charging means for charging a surface of the electrophotographic photosensitive member, exposure means for forming, by an exposure, an electrostatic latent image on the surface of the electrophotographic photosensitive member, developing means for developing an electrostatic latent image, formed by the exposure means on the surface of the electrophotographic photosensitive member, with a toner to form a toner image, and transfer means for transferring the toner image formed by the developing means on the surface of the electrophotographic photosensitive member onto a transfer material.

The present invention allows to provide an electrophotographic photosensitive member capable of suppressing a ghost phenomenon, even in a configuration having a conductive layer, an intermediate layer and a photosensitive layer in succession in this order on a substrate for covering a defect on the surface of the substrate, for improving a coating property of the photosensitive layer, for improving an adhesion between the substrate and the photosensitive layer, for protecting the photosensitive layer from an electrical destruction, for improving a charging property, and for improving a charge injecting property from the substrate to the photosensitive layer, by means of oxygen-deficient $SnO_2$ excellent in a reuse property.

The present invention also allows to provide a process cartridge and an electrophotographic apparatus provided with such electrophotographic photosensitive member.

DETAILED DESCRIPTION OF THE PREFERRED EMBODIMENTS

Figure 1A:
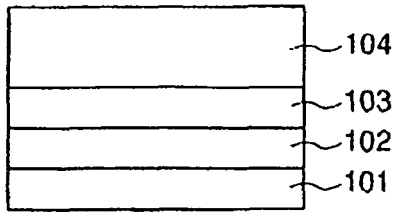
FIGS. 1A, 1B, 1C and 1D are views showing examples of a layer structure of an electrophotographic photosensitive member of the present invention.

In the following the present invention will be described in more details.

As explained above, an electrophotographic photosensitive member of the invention includes a conductive layer, an intermediate layer and a photosensitive layer in this order on a substrate, and the conductive layer contains a binder resin and conductive particles.

Also the invention employs, as conductive particles, $TiO_2$ particles coated with $SnO_2$ whose resistance is lowered (1/10,000 in powder resistivity) by an oxygen deficiency. The oxygen deficient $SnO_2$ has a superior reuse property to $SnO_2$ doped with a different element such as antimony.

In the invention, the conductive particles are not solely constituted of oxygen-deficient $SnO_2$ particles but of $TiO_2$ particles coated with oxygen-deficient $SnO_2$ for following reasons.

Firstly, core particles are employed for improving the dispersibility of the conductive particles in the conductive layer. In case a coating liquid for the conductive layer is prepared with the oxygen-deficient $SnO_2$ only as the conductive particles, such oxygen-deficient $SnO_2$ tends to cause agglomeration particularly in case it has a high content.

Also $TiO_2$ particles are employed as the core particles because an affinity of an oxygen-deficient portion of oxygen-deficient $SnO_2$ and an oxide portion on the $TiO_2$ particle surface strengthens a coupling between the coating layer of oxygen-deficient $SnO_2$ and the core material and also achieves a protection of the oxygen-deficient portion of oxygen-deficient $SnO_2$. An oxygen-deficient compound, different from a doped compound, may be oxidized in the presence of oxygen to lose the oxygen-deficient portion, thereby resulting in a decrease of electroconductivity (increase in powder resistivity).

Also in case an exposing light (image exposing light) is a laser light, the $TiO_2$ particles constituting the core material can suppress generation of interference fringes on an output image, by an interference of the light reflected on the substrate surface at the laser exposure.

A method for producing $TiO_2$ particles coated with oxygen-deficient $SnO_2$ (a method for producing oxygen-deficient $SnO_2$ and a method of coating the $TiO_2$ particles with oxygen-deficient $SnO_2$) is disclosed in Japanese Patent Application Laid-Open Nos. H07-295245 and H04-154621.

Also in case of employing the $TiO_2$ particles coated with oxygen-deficient $SnO_2$ as the conductive particles included in the conductive layer, it is necessary, in order to suppress generation of the ghost phenomenon, that the conductive layer has a volume resistivity of $5\times10^5$-$8\times10^8$ Ω·cm and that the conductive particles have an average particle size of 0.2-0.6 μm.

At first there will be explained a volume resistivity of the conductive layer.

As a cause for the ghost phenomenon is considered to be the stagnation of charge (carriers) in the formation of an electrostatic latent image on the electrophotographic photosensitive member, the conductive layer preferably has a low resistance, and it is found necessary, in order to sufficiently suppress the ghost phenomenon, that a resistance of the conductive layer in terms of volume resistivity is $8\times10^8$ Ω·cm or less. On the other hand, it is also found that an excessively low resistance reduces the charging ability and enhances the ghost phenomenon. More specifically, it is found necessary that a resistance of the conductive layer in terms of volume resistivity is $5\times10^5$ Ω·cm or higher. In particular, a resistance of the conductive layer in a volume resistivity is preferably $2\times10^6$ Ω·cm or higher.

In the invention, the volume resistivity of the conductive layer is measured in the following manner.

At first a conductive layer to be measured is formed with a film thickness of 2-5 μm on an aluminum sheet, then a thin gold film is formed on the conductive layer and a current flowing between the aluminum sheet and the gold film was measured with a pA meter, under a measuring environment of 23° C. and 60% RH and with an applied voltage of 0.1 V. A stabilized value was read after 1 minute from the start of current measurement, and a volume resistivity of the conductive layer was derived.

In order to obtain a volume resistivity of the conductive layer within the aforementioned range, the $TiO_2$ particles coated with oxygen-deficient $SnO_2$ as the conductive particles preferably has a powder resistivity of $1\times10^{-2}$-$5\times10^2$ Ω·cm, more preferably $1\times10^{-2}$-$2.5\times10^2$ Ω·cm. An excessively high powder resistivity makes it difficult to obtain the volume resistivity of the conductive layer within the aforementioned range, and an excessively low powder resistivity may deteriorate the charging ability.

The $TiO_2$ particles coated with oxygen-deficient $SnO_2$ having a powder resistivity within the aforementioned range can be stably obtained by controlling a blending ratio of raw materials at the preparation of the particles. For example, assuming that $SnO_2$ can be obtained with an yield of 100% from a tin raw material, there can be added, at the preparation of the particles, a tin raw material necessary for generating $SnO_2$ of 40-80% by weight with respect to the $TiO_2$ particles coated with oxygen-deficient $SnO_2$. Stated differently, a coating rate of the oxygen-deficient $SnO_2$ on $TiO_2$ is preferably 40-80% by weight.

In the invention, the powder resistivity is measured in the following manner.

As a measuring apparatus, Loresta AP manufactured by Mitsubishi Chemical Co. was employed. Powder (particles) to be measured was solidified under a pressure of 500 kg/cm$^2$ to obtain a pellet-shaped measuring sample. The measurement was conducted under an environment of 23° C. and 60% RH, with an applied voltage of 100 V.

In the following an average particle size of the $TiO_2$ particles coated with oxygen-deficient $SnO_2$ will be explained.

Even for a same composition of the conductive layer, an increase in the average particle size in the conductive particles reduces the powder resistivity of the conductive particles, and lowers the volume resistivity of the conductive layer.

In case the $TiO_2$ particles coated with oxygen-deficient $SnO_2$ have an average particle size less than 0.2 μm, it is necessary to increase the amount of the conductive particles in order to obtain the volume resistivity of the conductive layer within the aforementioned range, but, with such increased amount of the conductive particles, it becomes difficult to attain a surface roughness of the conductive layer (Rzjis: 1-3 μm) suitable for suppressing interference fringes in the output image, caused by an interference by a light reflected on the surface of the conductive layer. Rzjis means Rz defined in JIS B0601 (1994). In JIS B0601, Rz was replaced in a 2001 revision to Ry (maximum height) in 1994, and Rz in 1994 was renamed as Rzjis for the purpose of distinction in 2001.

On the other hand, in case the $TiO_2$ particles coated with oxygen-deficient $SnO_2$ have an average particle size exceeding 0.6 μm, the volume resistivity of the conductive layer is lowered but the effect for suppressing the ghost phenomenon decreases, whereby a fog tends to become noticeable in a background of the output image.

In the invention, the average particle size is measured in the following manner.

The dispersed particles were measured by a liquid phase precipitation method using a coating liquid for the conductive layer, containing the conductive particles only. More specifically, a coating liquid for the conductive layer was diluted with a solvent employed therein, and an average particle size was measured with an automatic ultra centrifuging particle size measuring apparatus CAPA 700, manufactured by Horiba Mfg. Co.

In the invention, the conductive layer is formed by coating and drying, on a substrate, a conductive layer coating liquid obtained by dispersing $TiO_2$ particles coated with oxygen-deficient $SnO_2$ having an average particle size of 0.2-0.6 μm with a binder resin in a solvent. The dispersion can be achieved for example by a paint shaker, a sand mill, a ball mill or a liquid collision type high-speed disperser.

A solvent to be employed in the conductive layer coating liquid can be, for example, an alcohol such as methanol, ethanol, or isopropanol, a ketone such as acetone, methyl ethyl ketone, or cyclohexanone, an ether such as tetrahydrofuran, dioxane, ethylene glycol monomethyl ether or propylene glycol monomethyl ether, an ester such as methyl acetate or ethyl acetate, or an aromatic hydrocarbon such as toluene or xylene.

In view of suppressing the ghost phenomenon, the conductive layer preferably has a thickness of 0.1-15 μm, more preferably 0.5-9 μm and further preferably 0.5-4.5 μm.

In the invention, the thickness of the layers of the electrophotographic photosensitive member, including the conductive layer, was measured with FISHERSCOPE mms manufactured by Fisher Instruments Inc.

A binder resin for the conductive layer can be phenolic resin, polyurethane resin, polyamide resin, polyimide resin, polyamidimide resin, polyamidic acid resin, polyvinylacetal resin, epoxy resin, acrylic resin, melamine resin or polyester resin. Such resin may be employed singly or in a combination of two or more. Among these resins, the binder resin for the conductive layer is preferably a hardening resin, more preferably a thermosetting resin, in consideration of a suppressed migration (dissolving) into another layer, an adhesion to the substrate, a dispersibility and a dispersion stability of the conductive particles, and a solvent resistance after film formation. More specifically, a thermosetting phenolic resin and a polyurethane resin are preferred.

Also a weight ratio (P/B) between the $TiO_2$ particles coated with oxygen-deficient $SnO_2$ having an average particle size of 0.2-0.6 μm as the conductive particles (P) and the binder resin (B) is preferably 3.5/1-6/1. An excessively small weight ratio (P/B) makes it difficult to maintain the volume resistivity of the conductive layer within the aforementioned range, while an excessively large weight ratio (P/B) renders it difficult to bind the $TiO_2$ particles coated with oxygen-deficient $SnO_2$ having an average particle size of 0.2-0.6 μm in the conductive layer.

Also in order to suppress the ghost phenomenon and to suppress interference fringes on the output image by an interference of the light reflected on the surface of the conductive layer, an average particle size (D [μm]) of the $TiO_2$ particles coated with oxygen-deficient $SnO_2$ as the conductive particles and the weight ratio (P/B) between the $TiO_2$ particles coated with oxygen-deficient $SnO_2$ having an average particle size of 0.2-0.6 μm as the conductive particles (P) and the binder resin (B) preferably satisfy a following relationship (1):

$$0.01\times(P/B)+0.28\leqq D\leqq 0.14\times(P/B) \quad (1)$$

The expression (1) indicates that with increase in the content of the $TiO_2$ particles coated with oxygen-deficient $SnO_2$, the interference fringes are liable to occur while local charge injection from the conductive layer to the photosensitive layer tends to be hindered, and so it is preferable to control the average particle size of the $TiO_2$ particles coated with oxygen-deficient $SnO_2$ according to the content of the $TiO_2$ particles coated with oxygen-deficient $SnO_2$ in the conductive layer. Such a tendency was clearly observed in the case where the weight ratio (P/B) was 3.5 or higher.

Also in order to control interference fringes on the output image ascribable to the interference of the light reflected on the surface of the conductive layer, it is preferable to add to the conductive layer, in addition to the binder resin and the $TiO_2$ particles coated with oxygen-deficient $SnO_2$ having an average particle size of 0.2 to 0.6 μm, a surface roughness providing material for roughening the surface of the conductive layer. The surface roughness providing material is preferably resin particles of an average particle size of 1 to 3 μm, for example particles of a hardening resin such as hardening rubber, polyurethane resin, epoxy resin, alkyd resin, phenolic resin, polyester resin, silicone resin or acryl-melamine resin. Among these, particles of silicone resin are preferable because they do not easily agglomerate. The resin particles, having a specific gravity (0.5 to 2) smaller than a specific gravity (4 to 7) of the $TiO_2$ particles coated with oxygen-deficient $SnO_2$, can effectively form a rough surface on the conductive layer at the formation thereof. However, since the volume resistivity of the conductive layer tends to increase as the content of the surface roughness providing material increases, the surface roughness providing material is preferably used in a content of 20 to 35% by weight with respect to the binder resin in the conductive layer.

Also a leveling agent may be added in order to improve the surface property of the conductive layer, and pigment particles may be added in order to increase concealing properties of the conductive layer.

In the case where the conductive layer has a volume resistivity of $5\times10^5$ to $8\times10^8$ Ω·cm as mentioned above, an intermediate layer having electrical barrier properties should be provided between the conductive layer and the photosensitive layer, in order to control a lowering of the charging ability and to prevent a charge injection from the conductive layer into the photosensitive layer. The intermediate layer preferably has a volume resistivity of $1\times10^9$-$1\times10^{12}$ Ω·cm. An excessively low volume resistivity of the intermediate layer results in poor electrical barrier properties, leading to a ghost phenomenon resulting from a charge injection from the conductive layer and fog. On the other hand, an excessively high volume resistivity of the intermediate layer results in the stagnation of the flow of charges (carriers) at the image formation, stimulating a ghost phenomenon and an increased residual potential (lack of potential stability).

In the invention, the volume resistivity of the intermediate layer is measured in the following manner.

At first an intermediate layer to be measured is formed in a film thickness of 2 to 5 μm on an aluminum sheet, then a thin gold film is formed on the conductive layer and a current flowing between the aluminum sheet and the gold film was measured with a pA meter, under the conditions of a measuring environment of 23° C. and 60% RH and an applied voltage of 100 V. A stabilized value was read after 1 minute from the start of current measurement, and a volume resistivity of the intermediate layer was derived.

The intermediate layer can be formed by applying on the conductive layer, and drying, an intermediate layer coating liquid containing a binder resin.

As a binder resin for the intermediate layer, the following may be cited: for example, a water-soluble resin such as polyvinyl alcohol, polyvinyl methyl ether, polyacrylic resin, methyl cellulose, ethyl cellulose, polyglutamic acid, casein or starch, polyamide resin, polyimide resin, polyamidimide resin, polyamidic acid resin, melamine resin, epoxy resin, polyurethane resin, or polyglutamate ester resin. The binder resin for the intermediate layer is preferably a thermoplastic resin in order to effectively realize electrical barrier properties and in view of coating properties, adhesion, solvent resistance and electrical resistance. More specifically, a thermoplastic polyamide resin and the like are preferable. Among the polyamide resin, for example, low-crystalline and amorphous copolymerized nylon are preferred because they can be applied in a solution. The intermediate layer preferably has a thickness of 0.1 to 2 μm.

In addition, in order to prevent a stagnation of the flow of charges (carriers), the intermediate layer may contain an electron transporting material (an electron accepting substance such as an acceptor).

In the following a configuration of the electrophotographic photosensitive member of the invention will be explained.

As shown in FIG. 1A, the electrophotographic photosensitive member of the invention has, in this order on a substrate 101, a conductive layer 102, an intermediate layer 103, and a photosensitive layer 104 (a charge generation layer 1041, a charge transport layer 1042).

Figure 1B:
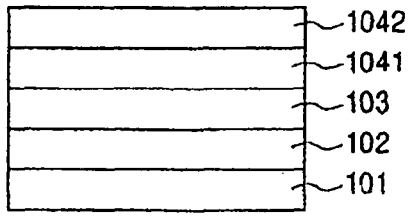
Figure 1C:
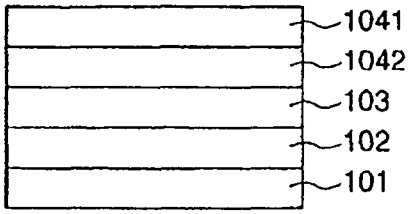

The photosensitive layer may be a single-layered photosensitive layer 104 containing a charge transport substance and a charge generation substance in the same layer (cf. FIG. 1A), or may be a laminated (function-separated) photosensitive layer separated into a charge generation layer 1041 containing a charge generation substance and a charge transport layer 1042 containing a charge transport substance, but is preferably the laminated type in consideration of the electrophotographic characteristics. Also the laminated type photosensitive layer includes a forward type photosensitive layer in which the charge generation layer 1041 and the charge transport layer 1042 are superposed in this order from the side of the substrate 101 (cf. FIG. 1B) and an inverted type photosensitive layer in which the charge transport layer 1042 and the charge generation layer 1041 are superposed in this order from the side of the substrate 101 (cf. FIG. 1C), and the forward type is preferred in consideration of the electrophotographic characteristics.

Figure 1D:
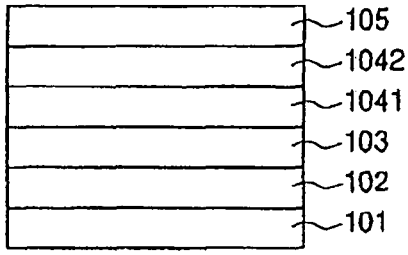

Also a protective layer 105 may be provided on the photosensitive layer 104 (charge generation layer 1041 or charge transport layer 1042) (cf. FIG. 1D).

As for the substrate, a substrate having an electrical conductivity (conductive substrate) is preferred, and a metal substrate may be used such as aluminum, an aluminum alloy or stainless steel. In the case of a substrate of aluminum or an aluminum alloy, the following may be used: an ED tube, an EI tube or such tubes which have been subjected to grinding, electrolytic composite polishing (electrolysis by an electrolytic electrode and an electrolyte solution and a grinding with a grindstone having a polishing function), or a wet or dry honing. It is also possible to use a metal substrate as mentioned above or a resinous substrate (such as of polyethylene terephthalate, polybutylene terephthalate, phenolic resin, polypropylene, polystyrene and the like) on which a film of aluminum, an aluminum alloy, or an indium oxide-tin oxide alloy is formed by vacuum evaporation. In addition, it is also possible to use a substrate formed by impregnating a resin or a paper with conductive particles such as carbon black, tin oxide particles, titanium oxide particles or silver particles, or a plastic material containing a conductive binder resin.

In order to dissipate charges (carriers) in the conductive layer to the ground, the conductive substrate or a layer provided for imparting an electrical conductivity to the substrate surface preferably has a volume resistivity of $1\times10^{10}$ Ω·cm or less, more preferably $1\times10^{6}$ Ω·cm or less.

In the case of employing a non-conductive substrate, a configuration of grounding the conductive layer of the electrophotographic photosensitive member is required.

A conductive layer is provided on the substrate, and an intermediate layer is provided on the conductive layer. The conductive layer and the intermediate layer are formed as explained above.

A photosensitive layer is formed on the intermediate layer.

A charge generation substance to be employed in the electrophotographic photosensitive member of the invention can be, for example, an azo pigment such as a monoazo pigment, a bisazo pigment or a trisazo pigment, a phthalocyanine pigment such as a metallic phthalocyanine or a non-metallic phthalocyanine, an indigo pigment such as indigo or thioindigo, a perylene pigment such as perylenic anhydride or perylenimide, a polycyclic quinone pigment such as anthraquinone or pyrenequinone, a squalirium dye, a pyrilium or thiapyrilium dye, a triphenylmethane dye, an inorganic substance such as selenium, selenium-tellurium or amorphous silicon, a quinacridone pigment, a azulenium salt pigment, a cyanine dye, a xanthene dye, a quinoneimine dye, a styryl dye, cadmium sulfide or zinc oxide. Among these, a metal phthalocyanine such as oxytitanium phthalocyanine, hydroxygallium phthalocyanine or chloro-oxygallium phthalocyanine is a charge generation substance which has a high sensitivity and tends to generate a ghost, and is preferable for effective exploitation of the present invention.

In the case where the photosensitive layer is a laminate photosensitive layer, a binder resin used in the charge generation layer can be, for example, polycarbonate resin, polyester resin, polyarylate resin, butyral resin, polystyrene resin, polyvinylacetal resin, diaryl phthalate resin, acrylic resin, methacrylic resin, vinyl acetate resin, phenolic resin, silicone resin, polysulfone resin, styrene-butadiene copolymer resin, alkyd resin, epoxy resin, urea resin, or vinyl chloride-vinyl acetate copolymer resin. These may be used singly or in a mixture of a copolymer of two or more kinds.

The charge generation layer can be formed by applying and drying a charge generation layer coating liquid obtained by dispersing a charge generation substance in a binder resin and a solvent. The dispersion can be prepared for example by means of homogenizer, an ultrasonic dispersion, a ball mill, a sand mill, an attriter, or a roll mill. A proportion of the charge generation substance and the binder resin is preferably 10:1 to 1:10 (weight ratio), more preferably 3:1 to 1:1 (weight ratio).

A solvent to be used for the charge generation layer coating liquid is selected in consideration of solubility and dispersion stability of the binder resin and the charge generation substance to be employed, and it is possible to use an organic solvent such as an alcohol, a sulfoxide, a ketone, an ether, an ester, an halogenated aliphatic hydrocarbon or an aromatic compound.

The charge generation layer coating liquid can be applied, for example, by a dip coating, a spray coating, a spinner coating, a roller coating, a Meyer bar coating or a blade coating.

The charge generation layer preferably has a film thickness of 5 μm or less, more preferably 0.1-2 μm.

The charge generation layer may include, if necessary, a sensitizer, an antioxidant, an ultraviolet absorber, a plasticizer and the like. In order to prevent the stagnation of the flow of charges (carriers) in the charge generation layer, an electron transport substance (an electron accepting substance such as an acceptor) may be included in the charge generation layer.

A charge transport substance to be employed in the electrophotographic photosensitive member of the invention may be, for example, a triarylamine compound, a hydrazone compound, a styryl compound, a stilbene compound, a pyrazoline compound, an oxazole compound, a thiazole compound, or a triallylmethane compound.

In the case where the photosensitive layer is a laminate photosensitive layer, a binder resin employed in the charge transport layer may be, for example, acrylic resin, styrene resin, polyester resin, polycarbonate resin, polyarylate resin, polysulfone resin, polyphenylene oxide resin, epoxy resin, polyurethane resink alkyd resin or an unsaturated resin. In particular, the following are preferred: polymethyl methacrylate resin, polystyrene resin, styrene-acrylonitrile copolymer resin, polycarbonate resin, polyarylate resin, or diaryl phthalate resin. These may be employed singly or in a mixture or a copolymer of two or more kinds.

The charge transport layer can be formed by coating and drying a charge transport layer coating liquid obtained by dispersing a charge transport substance in a binder resin and a solvent. A proportion of the charge transport substance and the binder resin is preferably 2:1 to 1:2 (weight ratio).

A solvent to be employed in the charge transport layer coating liquid may be, for example, a ketone such as acetone or methyl ethyl ketone, an ester such as methyl acetate or ethyl acetate, an ether such as dimethoxymethane or dimethoxyethane, an aromatic hydrocarbon such as toluene or xylene, or a halogen-substituted hydrocarbon such as chlorobenzene, chloroform, or carbon tetrachloride.

The charge transport layer coating liquid may be applied, for example, by a dip coating, a spray coating, a spinner coating, a roller coating, a Meyer bar coating or a blade coating.

The charge transport layer preferably has a film thickness of 5 to 40 μm, more preferably 10 to 30 μm, and further preferably within a range of 13 to 19 μm because a ghost can be prevented due to the charging ability and the strength of the electric field.

Also the charge transport layer may include, if necessary, an antioxidant, an ultraviolet absorber, a plasticizer and the like.

In the case where the photosensitive layer is of a single layer type, such a single-layer photosensitive layer can be formed by applying and drying a single-layer photosensitive layer coating liquid obtained by dispersing the aforementioned charge generation substance and the aforementioned charge transport substance together in a binder resin and a solvent.

On the photosensitive layer, a protective layer may be provided for the purpose of protecting the photosensitive layer. The protective layer can be formed by coating and drying a protective layer coating liquid obtained by dissolving various binder resins mentioned above in a solvent.

The protective layer preferably has a film thickness of 0.5 to 10 μm, more preferably 1 to 5 μm.

Figure 2:
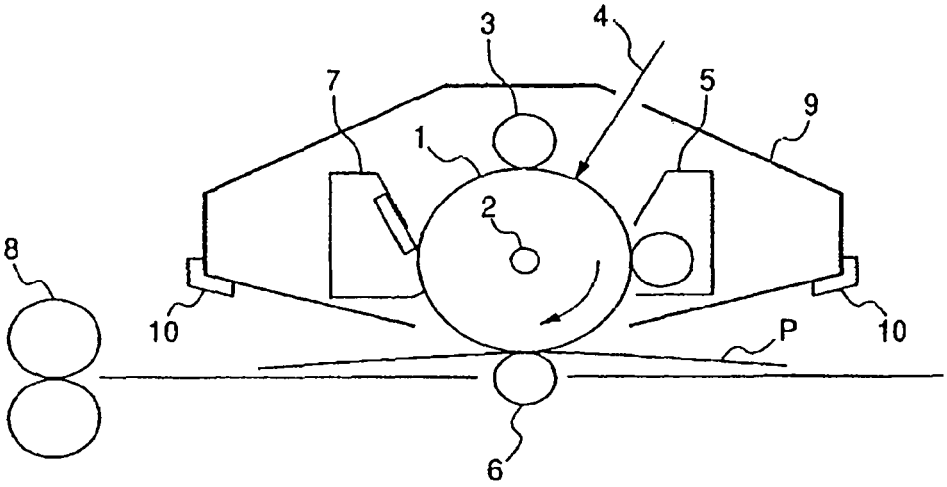
FIG. 2 is a schematic view showing a configuration of an electrophotographic apparatus provided with a process cartridge of the invention.

FIG. 2 shows an example of the configuration of an electrophotographic apparatus provided with a process cartridge of the invention.

Referring to FIG. 2, a drum-shaped electrophotographic photosensitive member 1 is rotated in the direction indicated by an arrow, about an axis 2 at a predetermined peripheral speed.

A periphery of the rotated electrophotographic photosensitive member 1 is uniformly charged by charging means 3 at a positive or negative predetermined potential, and then receives exposing light (image exposing light) 4 emitted from exposure means (not shown), such as a slit exposure or a laser beam scanning exposure. In this manner an electrostatic latent image corresponding to a desired image is formed in succession on the periphery of the electrophotographic photosensitive member 1. A voltage applied to the changing means 3 may be a DC voltage only, or a DC voltage superposed on an AC voltage.

The electrostatic latent image formed on the periphery of the electrophotographic photosensitive member 1 is developed with a toner of developing means 5 to form a toner image. Then the toner image borne on the periphery of the electrophotographic photosensitive member 1 is transferred by a transfer bias from transfer means (transfer roller) 6 in succession onto a transfer material (such as paper) P which is taken out and fed from transfer material supply means (not shown) to a contact portion between the electrophotographic photosensitive member 1 and the transfer means 6, while synchronized with the rotation of the electrophotographic photosensitive member 1.

The transfer material P, having received the transferred toner image, is separated from the periphery of the electrophotographic photosensitive member 1, then guided to fixing means 8 and subjected to image fixation, whereby a formed image (print or copy) is discharged from the apparatus.

The periphery of the electrophotographic photosensitive member 1, after the transfer of the toner image, is cleaned by an elimination of a transfer residual toner by cleaning means (such as a cleaning blade) 7.

Among the aforementioned constituents of the electrophotographic photosensitive member 1, the charging means 3, the developing means 5, the transfer means 6 and the cleaning means 7, plural ones may be held together in a container to constitute a process cartridge as one unit, which may be detachably mounted on the main body of the electrophotographic apparatus such as a copying apparatus or a laser beam printer. In FIG. 2, the electrophotographic photosensitive member 1, the contact charging means 3, the developing means 5 and the cleaning means 7 are held together to constitute a cartridge 9 as one unit, which is detachably mountable in the main body of the electrophotographic apparatus, utilizing guide means 10 such as rails therein.

EXAMPLES

In the following the present invention will be clarified further by examples, but the present invention is not limited to such examples. In the following examples, "part(s)" means "part(s) by weight".

Example 1

An aluminum cylinder with a length of 260.5 mm and a diameter of 30 mm obtained by a hot extrusion in an environment of 23° C. and 60% RH (JIS-A3003, aluminum alloy ED tube, manufactured by Showa Aluminum Co.) was employed as a substrate. The surface of the substrate had Rzjis of 0.8 μm.

In the present invention, the Rzjis was measured according to JIS-B0601 (1994), by employing a surface roughness meter SURFCORDER SE3500, manufactured by Kosaka Kenkyusho Co., under conditions of a feed rate of 0.1 mm/s, a cut-off λc of 0.8 mm and a measured length of 2.50 mm.

Then, 7.90 parts of $TiO_2$ particles coated with oxygen-deficient $SnO_2$ as conductive particles (powder resistivity: 80 Ω·cm, $SnO_2$ covering rate (weight ratio): 50%), 3.30 parts of a phenolic binder resin (trade name: Plyophen J-325, manufactured by Dainippon Inks and Chemicals Inc., resin solid component: 60%), and 8.60 parts of methoxypropanol as a solvent were dispersed for 3 hours by using a sand mill utilizing glass beads with a diameter of 1 mm to obtain a dispersion liquid.

In this dispersion liquid, the $TiO_2$ particles coated with oxygen-deficient $SnO_2$ had an average particle size of 0.45 μm.

To this dispersion liquid, 0.5 parts of silicone resin particles as a surface roughness providing material (trade name: Tospal 120, manufactured by GE-Toshiba Silicone Co., average particle size: 2 μm) and 0.001 parts of a silicone oil as a leveling agent (trade name: SH28PA, manufactured by Toray-Dow Corning Silicone Co.) were added, and the mixture was agitated to obtain a conductive layer coating liquid.

This conductive layer coating liquid was dip coated on the substrate in an environment of 23° C. and 60% RH, and dried and thermally set for 30 minutes at 140° C. to form a conductive layer with a thickness of 4 μm. The surface of the conductive layer had Rzjis of 1.5 μm.

Separately, the conductive layer coating liquid was applied by using a Meyer bar on an aluminum sheet and dried with a film thickness of 4 μm to obtain a sample for measuring a volume resistivity of the conductive layer. After a thin gold film was formed by evaporation on the conductive layer, the volume resistivity thereof was measured as $5.5\times10^{7}$ Ω·cm.

Then, an intermediate layer coating liquid, formed by dissolving 4 parts of N-methoxymethylated nylon (trade name: Toresin EF-30T, manufactured by Teikoku Kagaku Sangyo Co.) and 2 parts of copolymerized nylon resin (Amilan CM8000, manufactured by Toray Ltd.) in a mixed solvent of 65 parts of methanol and 30 parts of n-butanol, was dip coated on the conductive layer and dried for 10 minutes at 100° C. to obtain an intermediate layer with a thickness of 0.5 μm.

Separately, the intermediate layer coating liquid was applied by using a Meyer bar on an aluminum sheet and dried with a film thickness of 3 μm to obtain a sample for measuring a volume resistivity of the intermediate layer. After a thin gold film was formed by evaporation on the intermediate layer, the volume resistivity thereof was measured as $5\times10^{11}$ Ω·cm.

Then, 10 parts of a crystalline hydroxygallium phthalocyanine showing strong peaks at Bragg's angle (2θ±0.2°), in a specific CuKα X-ray diffraction, at 7.5°, 9.9°, 16.3°, 18.6°, 25.1° and 28.3°, 5 parts of polyvinyl butyral (trade name: S-LEC BX-1, manufactured by Sekisui Chemical Co.) and 250 parts of cyclohexanone were dispersed for 1 hour by employing a sand mill utilizing glass beads with a diameter of 1 mm, and 250 parts of ethyl acetate were added to obtain a charge generation layer coating liquid.

The charge generation layer coating liquid was dip coated on the intermediate layer and dried for 10 minutes at 100° C. to obtain a charge generation layer with a thickness of 0.16 μm.

Then, 10 parts of an amine compound represented by the following formula:

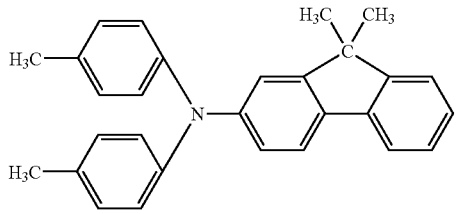

and 10 parts of a polycarbonate resin (trade name: Z400, manufactured by Mitsubishi Engineering Plastics Co.) were dissolved in a mixed solvent of 30 parts of dimethoxymethane and 70 parts of chlorobenzene to obtain a charge transport layer coating liquid.

The charge transport layer coating liquid was dip coated on the charge generation layer and dried for 30 minutes at 120° C. to obtain a charge transport layer with a thickness of 17 μm.

An electrophotographic photosensitive member having a charge transport layer as a surface layer was thus prepared.

The electrophotographic photosensitive member prepared was mounted in a laser beam printer LBP-2510, manufactured by Canon Inc., in which a pre-exposure unit was cut off from the power supply, and was subjected in an environment of 15° C. and 10% RH to an image evaluation in an initial state and after copying 3,000 sheets and to a measurement of the surface potential of the electrophotographic photosensitive member. Details are shown in the following.

The electrophotographic photosensitive member prepared was incorporated in a cyan-color process cartridge of the laser beam printer LBP-2510, and the evaluation was conducted by mounting the process cartridge in a cyan station of the printer.

For sheet copying, 3,000 sheets were outputted by a full-color printing operation in an intermittent mode in which a character image with a print rate of 2% was outputted on a letter-sized paper in every 20 seconds.

At the start of the evaluation and after copying 3,000 sheets, four samples for image evaluation (solid white, ghost chart, solid black and knight's move pattern halftone image) were outputted.

The ghost chart has a solid white area within a range of 30 mm from an image print starting position (10 mm from an upper end of the sheet), in which four solid black squares of a side of 25 mm are arranged at the image print starting position in parallel manner with equal distances, and, after 30 mm from the image print starting position, has a halftone image of a knight's move pattern (in which a pattern of a knight of Japanese chess (i.e., 2 dots are printed in every 6 squares) is repeated). The half-toner comprises of dotted lines arranged every other line in which each of the dotted lines is composed of black dots arranged every other dots and the dot arrangements of the adjacent dotted lines are opposite to each other.

The image evaluation was conducted by the following criteria.

The ghost phenomenon was evaluated, from the ghost chart, as A: completely no ghost, B: almost no ghost, C: ghost slightly observed, D: ghost observed, and E: ghost clearly observed.

The interference fringes were evaluated, from the halftone image of the knight's move pattern, as A: completely no interference fringes, C: interference fringes slightly observed, and D: interference fringes observed.

A fog and a spot were evaluated from the solid white image. No comment is made in the absence of fog or a spot.

After the output of the samples for image evaluation, the electrophotographic photosensitive member was mounted on an apparatus for measuring the surface potential of the electrophotographic photosensitive member (an apparatus in which a probe for measuring the surface potential of the electrophotographic photosensitive member was mounted in a position of the developing roller of the process cartridge (toner, developing roller and cleaning blade being removed)), and the ghost potential was measured in a state where an electrostatic transfer belt unit was detached from the LBP-2510.

The ghost potential was measured in the following manner.

At first, there was executed a print mode of a ghost potential measuring chart of letter size (having a solid black image in a range of 25 mm from the image print starting position (10 mm from the upper end of the sheet), then a solid white image in a range of 25 to 30 mm from the image print starting position, and, after 30 mm from the image print starting position, a halftone image of repeating knight's move patterns) without feeding sheet, and the surface potential of the electrophotographic photosensitive member was measured in a cyan process cartridge.

Then a difference between a halftone potential after a turn of the solid black area and a halftone potential before or after (the halftone potential after a turn of the solid black area being smaller than the halftone potential immediately before or after) was taken as a ghost potential.

Results are summarized in Table 1.

Example 2

An electrophotographic photosensitive member was prepared and evaluated in the same manner as in Example 1, except for following points. Obtained results are shown in Table 1.

In the conductive layer, an amount of the $TiO_2$ particles coated with oxygen-deficient $SnO_2$ as the conductive particles was changed to 7.63 parts, and an amount of the phenolic resin as the binder resin for the conductive layer was changed to 3.75 parts. As a result, the conductive layer had a surface roughness Rzjis of 1.7 μm and a volume resistivity of $8\times10^8$ Ω·cm.

Example 3

An electrophotographic photosensitive member was prepared and evaluated in the same manner as in Example 1, except for following points. Obtained results are shown in Table 1.

In the conductive layer, an amount of the $TiO_2$ particles coated with oxygen-deficient $SnO_2$ as the conductive particles was changed to 7.73 parts, and an amount of the phenolic resin as the binder resin for the conductive layer was changed to 3.58 parts. As a result, the conductive layer had a surface roughness Rzjis of 1.6 μm and a volume resistivity of $9\times10^7$ Ω·cm.

Example 4

An electrophotographic photosensitive member was prepared and evaluated in the same manner as in Example 1, except for following points. Obtained results are shown in Table 1.

In the conductive layer, an amount of the $TiO_2$ particles coated with oxygen-deficient $SnO_2$ as the conductive particles was changed to 8.40 parts, and an amount of the phenolic resin as the binder resin for the conductive layer was changed to 2.46 parts. As a result, the conductive layer had a surface roughness Rzjis of 1.5 μm and a volume resistivity of $2\times10^6$ Ω·cm.

Example 5

An electrophotographic photosensitive member was prepared and evaluated in the same manner as in Example 1, except for following points. Obtained results are shown in Table 1.

In the conductive layer, an amount of the $TiO_2$ particles coated with oxygen-deficient $SnO_2$ as the conductive particles was changed to 8.51 parts, and an amount of the phenolic resin as the binder resin for the conductive layer was changed to 2.28 parts. As a result, the conductive layer had a surface roughness Rzjis of 1.4 μm and a volume resistivity of $5\times10^5$ Ω·cm.

Example 6

An electrophotographic photosensitive member was prepared and evaluated in the same manner as in Example 1, except for following points. Obtained results are shown in Table 1.

In the conductive layer, the conductive particles were changed to $TiO_2$ particles coated with oxygen-deficient $SnO_2$ (powder resistivity: 40 Ω·cm, $SnO_2$ coating rate (weight ratio): 60%) by 8.08 parts, and an amount of the phenolic resin as the binder resin for the conductive layer was changed to 3.00 parts. The $TiO_2$ particles coated with oxygen-deficient $SnO_2$ had an average particle size of 0.46 μm. As a result, the conductive layer had a surface roughness Rzjis of 1.5 μm and a volume resistivity of $4\times10^7$ Ω·cm.

Example 7

An electrophotographic photosensitive member was prepared and evaluated in the same manner as in Example 1, except for following points. Obtained results are shown in Table 1.

In the conductive layer, the conductive particles were changed to $TiO_2$ particles coated with oxygen-deficient $SnO_2$ (powder resistivity: 600 Ω·cm, $SnO_2$ coating rate (weight ratio): 35%) by 7.90 parts. The $TiO_2$ particles coated with oxygen-deficient $SnO_2$ had an average particle size of 0.22 μm. As a result, the conductive layer had a surface roughness Rzjis of 1.05 μm and a volume resistivity of $2\times10^8$ Ω·cm.

Example 8

An electrophotographic photosensitive member was prepared and evaluated in the same manner as in Example 1, except for following points. Obtained results are shown in Table 1.

In the conductive layer, the conductive particles were changed to $TiO_2$ particles coated with oxygen-deficient $SnO_2$ (powder resistivity: 400 Ω·cm, $SnO_2$ coating rate (weight ratio): 40%) by 7.90 parts. The $TiO_2$ particles coated with oxygen-deficient $SnO_2$ had an average particle size of 0.30 μm. As a result, the conductive layer had a surface roughness Rzjis of 1.15 μm and a volume resistivity of $1.5\times10^8$ Ω·cm.

Example 9

An electrophotographic photosensitive member was prepared and evaluated in the same manner as in Example 1, except for following points. Obtained results are shown in Table 1.

In the conductive layer, the conductive particles were changed to $TiO_2$ particles coated with oxygen-deficient $SnO_2$ (powder resistivity: 100 Ω·cm, $SnO_2$ coating rate (weight ratio): 50%) by 7.90 parts. The $TiO_2$ particles coated with oxygen-deficient $SnO_2$ had an average particle size of 0.33 μm. As a result, the conductive layer had a surface roughness Rzjis of 1.2 μm and a volume resistivity of $7\times10^7$ Ω·cm.

Example 10

An electrophotographic photosensitive member was prepared and evaluated in the same manner as in Example 1, except for following points. Obtained results are shown in Table 1.

In the conductive layer, the conductive particles were changed to $TiO_2$ particles coated with oxygen-deficient $SnO_2$ (powder resistivity: 40 Ω·cm, $SnO_2$ coating rate (weight ratio): 75%) by 7.90 parts. The $TiO_2$ particles coated with oxygen-deficient $SnO_2$ had an average particle size of 0.55 μm. As a result, the conductive layer had a surface roughness Rzjis of 1.6 μm and a volume resistivity of $3\times10^7$ Ω·cm.

Example 11

An electrophotographic photosensitive member was prepared and evaluated in the same manner as in Example 1, except for following points. Obtained results are shown in Table 1.

In the conductive layer, the conductive particles were changed to $TiO_2$ particles coated with oxygen-deficient $SnO_2$ (powder resistivity: 0.5 Ω·cm, $SnO_2$ coating rate (weight ratio): 85%) by 7.90 parts. The $TiO_2$ particles coated with oxygen-deficient $SnO_2$ had an average particle size of 0.58

μm. As a result, the conductive layer had a surface roughness Rzjis of 1.65 μm and a volume resistivity of $8\times10^6$ Ω·cm.

Example 12

An electrophotographic photosensitive member was prepared and evaluated in the same manner as in Example 1, except for following points. Obtained results are shown in Table 1.

The substrate was changed to a following ground tube.

An aluminum bare tube (JIS-A6063) with an external diameter of 30.5 mm, an internal diameter of 28.5 mm, a length of 260.5 mm, a bend precision of 100 μm, Rzjis of 10 μm, obtained by a hot extrusion, was mounted on a lathe and ground with a sintered diamond bite to obtain an external diameter of 30.0±0.02 mm, a bend precision of 15 μm and Rzjis of 0.5 μm, thereby obtaining a ground tube with Rzjis of 0.5 μm. The operation was executed with a main shaft revolution of 3,000 rpm, a bite feeding rate of 0.3 mm/rev and a work time of 24 seconds excluding an attaching/detaching operation of the work. Also a thickness of the conductive layer was changed to 0.4 μm.

As a result, the conductive layer had a surface roughness Rzjis of 2.2 μm.

Example 13

An electrophotographic photosensitive member was prepared and evaluated in the same manner as in Example 1, except for following points. Obtained results are shown in Table 1.

The substrate was changed to an aluminum cylinder of JIS-A3003, subjected to a wet honing process (with a wet honing apparatus manufactured by Fuji Seiki Seisakusho) under following conditions to obtain Rzjis of 2.0 μm.

—Honing Conditions— grinding particles: spherical alumina beads of an average particle size of 30 μm (trade name: CB-A30S, manufactured by Showa Denko Co.);

suspension medium: water;

grinding particles/suspension medium=1/9 (volume ratio);

aluminum cylinder revolution: 1.67 $s^{-1}$;

air blow pressure: 0.165 MPa;

gun moving speed: 13.3 mm/s;

distance of gun nozzle and aluminum cylinder: 180 mm;

emission angle of grinding particles: 45°;

number of emission of grinding liquid (grinding particles and suspension medium): 1 time;

Also the thickness of the conductive layer was changed to 0.6 μm.

As a result, the conductive layer had a surface roughness Rzjis of 1.9 μm.

Example 14

An electrophotographic photosensitive member was prepared and evaluated in the same manner as in Example 1, except for following points. Obtained results are shown in Table 1.

The thickness of the conductive layer was changed to 4.4 μm. As a result, the conductive layer had a surface roughness Rzjis of 1.5 μm.

Example 15

An electrophotographic photosensitive member was prepared and evaluated in the same manner as in Example 1, except for following points. Obtained results are shown in Table 1.

The thickness of the conductive layer was changed to 4.7 μm. As a result, the conductive layer had a surface roughness Rzjis of 1.5 μm.

Example 16

An electrophotographic photosensitive member was prepared and evaluated in the same manner as in Example 1, except for following points. Obtained results are shown in Table 1.

The thickness of the conductive layer was changed to 8.5 μm. As a result, the conductive layer had a surface roughness Rzjis of 1.3 μm.

Example 17

An electrophotographic photosensitive member was prepared and evaluated in the same manner as in Example 1, except for following points. Obtained results are shown in Table 1.

The binder resin of the conductive layer was changed to polyester-polyurethane (trade name: NIPPORANE 2304, manufactured by Nippon Polyurethane Ltd., solid component 70%) by 3.30 parts, and the thickness of the conductive layer was changed to 9.5 μm. As a result, the conductive layer had a surface roughness Rzjis of 1.3 μm, and a volume resistivity of $5.5\times10^8$ Ω·cm.

Example 18

An electrophotographic photosensitive member was prepared and evaluated in the same manner as in Example 1, except for following points. Obtained results are shown in Table 1.

In the conductive layer, the amount of the silicone resin particles as the surface roughness providing material was changed to 0.38 parts. As a result, the conductive layer had a surface roughness Rzjis of 0.95 μm, and a volume resistivity of $5.5\times10^7$ Ω·cm.

Example 19

An electrophotographic photosensitive member was prepared and evaluated in the same manner as in Example 1, except for following points. Obtained results are shown in Table 1.

In the conductive layer, the amount of the silicone resin particles as the surface roughness providing material was changed to 0.41 parts. As a result, the conductive layer had a surface roughness Rzjis of 1.1 μm, and a volume resistivity of $5.5\times10^7$ Ω·cm.

Example 20

An electrophotographic photosensitive member was prepared and evaluated in the same manner as in Example 1, except for following points. Obtained results are shown in Table 1.

In the conductive layer, the amount of the silicone resin particles as the surface roughness providing material was changed to 0.68 parts. As a result, the conductive layer had a surface roughness Rzjis of 1.8 μm, and a volume resistivity of $5.5\times10^7$ Ω·cm.

Example 21

An electrophotographic photosensitive member was prepared and evaluated in the same manner as in Example 1, except for following points. Obtained results are shown in Table 1.

In the conductive layer, the surface roughness providing material was changed silicone resin particles (trade name: Tospal 145, manufactured by GE-Toshiba Silicone Co.) by 0.71 parts. The silicone resin particles had an average particle size of 4.5 μm. As a result, the conductive layer had a surface roughness Rzjis of 1.9 μm, and a volume resistivity of $5.5\times 10^7$ Ω·cm.

Example 22

An electrophotographic photosensitive member was prepared and evaluated in the same manner as in Example 1, except for following points. Obtained results are shown in Table 1.

The intermediate layer was changed to a thickness of 0.07 μm, and the charge transport layer was changed to a thickness of 20 μm.

Example 23

An electrophotographic photosensitive member was prepared and evaluated in the same manner as in Example 1, except for following points. Obtained results are shown in Table 1.

The intermediate layer was changed to a thickness of 0.15 μm, and the charge transport layer was changed to a thickness of 18 μm.

Example 24

An electrophotographic photosensitive member was prepared and evaluated in the same manner as in Example 1, except for following points. Obtained results are shown in Table 1.

The intermediate layer was changed to a thickness of 1.8 μm, and the charge transport layer was changed to a thickness of 13 μm.

Example 25

An electrophotographic photosensitive member was prepared and evaluated in the same manner as in Example 1, except for following points. Obtained results are shown in Table 1.

The intermediate layer was changed to a thickness of 2.2 μm, and the charge transport layer was changed to a thickness of 12 μm.

Example 26

An electrophotographic photosensitive member was prepared and evaluated in the same manner as in Example 1, except that the binder resin for the charge transport layer was changed to a polyarylate resin (viscosity-averaged molecular weight (Mv): 42,000) having a repeating structural unit represented by a following formula:

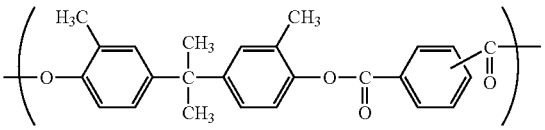

The polyarylate resin having a repeating structural unit represented by the foregoing formula had a molar ratio of a terephthalic acid structure and an isophthalic acid structure (telephthalic acid structure:isophthalic acid structure) of 50:50.

The viscosity-averaged molecular weight was measured in the following manner.

0.5 g of a sample were dissolved in 100 ml of methylene chloride, and a specific viscosity at 25° C. was measured with an improved Ubbelohde viscosimeter. Then a limit viscosity was determined from the specific viscosity, and a viscosity-averaged molecular weight (Mv) was derived by a Mark-Houwink viscosity equation. The viscosity-averaged molecular weight (Mv) was represented by a polystyrene-converted value obtained by GPC (gel permeation chromatography).

The prepared electrophotographic photosensitive member was mounted in a laser beam printer LBP-1760, manufactured by Canon Inc., without a pre-exposure unit, and was subjected in an environment of 15° C. and 10% RH to an image evaluation in an initial state and after copying 3,000 sheets and to a measurement of the surface potential of the electrophotographic photosensitive member. Details are shown in the following.

The electrophotographic photosensitive member prepared was evaluated by incorporating in a process cartridge of the laser beam printer LBP-1760.

For sheet copying, 3,000 sheets were outputted by a full-color printing operation in an intermittent mode in which a character image with a print rate of 2% was outputted on a letter-sized paper in every 15 seconds.

At the start of the evaluation and after copying 3,000 sheets, four samples for image evaluation (solid white, ghost chart, solid black and knight's move pattern halftone image) were outputted.

The ghost chart and the knight's move pattern are same as those in Example 1.

The image evaluation was conducted in the criteria same as those in Example 1.

After the output of the samples for image evaluation, the electrophotographic photosensitive member was mounted on an apparatus for measuring the surface potential of the electrophotographic photosensitive member (an apparatus in which a probe for measuring the surface potential of the electrophotographic photosensitive member was mounted in a position of the developing roller of the process cartridge (toner, developing sleeves and cleaning blade being removed)), and the ghost potential was measured in a state without sheet passing, where transfer roller was detached from the LBP-1760.

The ghost potential was measured in the same manner as in Example 1.

Results are shown in Table 1.

TABLE 1

| | Image evaluation | | | | Ghost potential | |
|---|---|---|---|---|---|---|
| | Ghost | | | | | |
| Example | initial state | after 3000 sheets | inter-ference fringes | fog, spot | initial state [V] | after 3000 sheets [V] |
| 1 | A | A | A | | 5 | 7 |
| 2 | A | B | A | | 6 | 8 |
| 3 | A | A | A | | 5 | 7 |
| 4 | A | A | A | | 5 | 7 |
| 5 | A | B | A | | 7 | 9 |
| 6 | A | A | A | | 4 | 6 |
| 7 | A | B | A | | 7 | 9 |
| 8 | A | B | A | | 6 | 8 |

TABLE 1-continued

| | Image evaluation | | | | Ghost potential | |
|---|---|---|---|---|---|---|
| | Ghost | | | | | after |
| Example | initial state | after 3000 sheets | inter-ference fringes | fog, spot | initial state [V] | 3000 sheets [V] |
| 9 | A | A | A | | 5 | 7 |
| 10 | A | A | A | | 5 | 7 |
| 11 | A | B | A | | 7 | 9 |
| 12 | A | A | A | Slight black spots from start to after dura-bility test | 5 | 7 |
| 13 | A | A | A | | 5 | 7 |
| 14 | A | A | A | | 5 | 7 |
| 15 | A | B | A | | 6 | 8 |
| 16 | A | B | A | | 6 | 8 |
| 17 | B | B | A | | 8 | 10 |
| 18 | A | A | C | | 5 | 7 |
| 19 | A | A | A | | 5 | 7 |
| 20 | A | A | A | | 5 | 7 |
| 21 | A | B | A | | 6 | 8 |
| 22 | A | B | A | | 7 | 9 |
| 23 | A | A | A | | 5 | 7 |
| 24 | A | A | A | | 5 | 7 |
| 25 | A | B | A | | 7 | 9 |
| 26 | A | A | A | | 5 | 7 |

Comparative Example 1

An electrophotographic photosensitive member was prepared and evaluated in the same manner as in Example 1, except for following points. Obtained results are shown in Table 2.

In the conductive layer, the conductive particles were changed to $TiO_2$ particles coated with oxygen-deficient $SnO_2$ (powder resistivity: 0.5 Ω·cm, $SnO_2$ coating rate (weight ratio): 80%) by 8.36 parts, and an amount of the phenolic resin as the binder resin for the conductive layer was changed to 2.53 parts. The $TiO_2$ particles coated with oxygen-deficient $SnO_2$ had an average particle size of 0.6 μm. As a result, the conductive layer had a surface roughness Rzjis of 1.4 μm and a volume resistivity of $4\times10^5$ Ω·cm.

Comparative Example 2

An electrophotographic photosensitive member was prepared and evaluated in the same manner as in Example 1, except for following points. Obtained results are shown in Table 2.

In the conductive layer, the conductive particles were changed to $TiO_2$ particles coated with oxygen-deficient $SnO_2$ (powder resistivity: 800 Ω·cm, $SnO_2$ coating rate (weight ratio): 40%) by 7.68 parts, and an amount of the phenolic resin as the binder resin for the conductive layer was changed to 3.66 parts. The $TiO_2$ particles coated with oxygen-deficient $SnO_2$ had an average particle size of 0.1 μm. As a result, the conductive layer had a surface roughness Rzjis of 0.85 μm and a volume resistivity of $7\times10^8$ Ω·cm.

Comparative Example 3

An electrophotographic photosensitive member was prepared and evaluated in the same manner as in Example 1, except for following points. Obtained results are shown in Table 2.

In the conductive layer, the conductive particles were changed to $TiO_2$ particles coated with oxygen-deficient $SnO_2$ (powder resistivity: 10 Ω·cm, $SnO_2$ coating rate (weight ratio): 50%) by 7.90 parts. The $TiO_2$ particles coated with oxygen-deficient $SnO_2$ had an average particle size of 0.7 μm. As a result, the conductive layer had a surface roughness Rzjis of 1.6 μm and a volume resistivity of $6\times10^5$ Ω·cm.

Comparative Example 4

An electrophotographic photosensitive member was prepared and evaluated in the same manner as in Example 1, except for following points. Obtained results are shown in Table 2.

In the conductive layer, the conductive particles were changed to $TiO_2$ particles coated with $SnO_2$ doped with antimony oxide by 10% by weight (powder resistivity: 10 Ω·cm, $SnO_2$ coating rate (weight ratio): 50%) by 7.90 parts. The $TiO_2$ particles coated with $SnO_2$ containing antimony oxide by 10% by weight had an average particle size of 0.7 μm. As a result, the conductive layer had a surface roughness Rzjis of 1.6 μm and a volume resistivity of $5\times10^5$ Ω·cm.

Comparative Example 5

An electrophotographic photosensitive member was prepared and evaluated in the same manner as in Example 1, except for following points. Obtained results are shown in Table 2.

In the conductive layer, the conductive particles were changed to barium sulfate particles coated with oxygen-deficient $SnO_2$ (powder resistivity: 950 Ω·cm, $SnO_2$ coating rate (weight ratio): 30%) by 7.90 parts, and the thickness of the conductive layer was changed to 6 μm. The barium sulfate particles coated with oxygen-deficient $SnO_2$ had an average particle size of 0.1 μm. As a result, the conductive layer had a surface roughness Rzjis of 0.85 μm and a volume resistivity of $7\times10^8$ Ω·cm.

Comparative Example 6

An electrophotographic photosensitive member was prepared and evaluated in the same manner as in Example 1, except for following points. Obtained results are shown in Table 2.

In the conductive layer, the conductive particles were changed to $TiO_2$ particles coated with $SnO_2$ which is not doped nor subjected to an oxygen deficiency treatment (powder resistivity: 80,000 Ω·cm, $SnO_2$ coating rate (weight ratio): 50%) by 7.90 parts. The $TiO_2$ particles coated with $SnO_2$ which is not doped nor subjected to an oxygen deficiency treatment had an average particle size of 0.45 μm. As a result, the conductive layer had a surface roughness Rzjis of 1.5 μm and a volume resistivity of $6\times10^{10}$ Ω·cm.

Comparative Example 7

An electrophotographic photosensitive member was prepared and evaluated in the same manner as in Example 1, except for following points. Obtained results are shown in Table 2.

In the conductive layer, the conductive particles were changed to agglomerated particles of oxygen-deficient $SnO_2$ (powder resistivity: 0.5 Ω·cm, no core material) by 7.90 parts. The agglomerated particles of oxygen-deficient $SnO_2$ had an average particle size of 0.7 μm. As a result, the conductive layer had a surface roughness Rzjis of 1.6 μm and a volume resistivity of $5\times10^6$ Ω·cm.

TABLE 2

| | Image evaluation | | | | Ghost potential | |
|---|---|---|---|---|---|---|
| | Ghost | | | | | |
| Comp. Example | initial state | after 3000 sheets | inter-ference fringes | fog, spot | initial state [V] | after 3000 sheets [V] |
| 1 | B | E | A | fog generated after dura-bility test | 8 | 15 |
| 2 | B | D | C | | 7 | 12 |
| 3 | B | E | A | fog generated after dura-bility test | 7 | 15 |
| 4 | B | E | A | fog generated after dura-bility test | 8 | 15 |
| 5 | B | D | D | | 7 | 12 |
| 6 | B | E | A | | 8 | 15 |
| 7 | B | E | C | fog generated after dura-bility test | 8 | 15 |

In the present invention, a film thickness or a surface roughness is an average value within a range of ±25 mm at the center in the longitudinal direction of the electrophotographic photosensitive member.

As will be understood from the foregoing results, the present invention can provide an electrophotographic photosensitive member, even in a configuration having a conductive layer, an intermediate layer and a photosensitive layer in succession in this order on a substrate for covering a defect on the surface of the substrate, for improving a coating property of the photosensitive layer, for improving an adhesion between the substrate and the photosensitive layer, for protecting the photosensitive layer from an electrical destruction, for improving a charging property, and for improving a charge injecting property from the substrate to the photosensitive layer, capable of suppressing a ghost phenomenon by means of oxygen-deficient $SnO_2$ having an excellent reuse property.

The present invention can also provide a process cartridge and an electrophotographic apparatus provided with such electrophotographic photosensitive member.

This application claims priority from Japanese Patent Application No. 2003-340785 filed on Sep. 30, 2003, which is hereby incorporated by reference herein.

What is claimed is:

1. An electrophotographic photosensitive member comprising a conductive layer, an intermediate layer and a photosensitive layer in this order on a substrate, in which the conductive layer contains a binder resin and conductive particles, wherein:

the conductive particles are $TiO_2$ particles coated with oxygen-deficient $SnO_2$;

the conductive particles have an average particle size of 0.2 to 0.6 μm;

the conductive layer has a volume resistivity of $5\times10^5$ to $8\times10^8$ Ω·cm; and an average particle size (D [μm]) of the conductive particles, and a weight ratio (P/B) of the conductive particles (P) and the binder resin (B) in the conductive layer, satisfy a following relation (1):

$$0.01\times(P/B)+0.28\leqq D\leqq 0.14\times(P/B) \quad (1).$$

2. An electrophotographic photosensitive member according to claim 1, wherein the conductive particles have a powder resistivity of $1\times10^{-2}$ to $5\times10^2$ cm.

3. An electrophotographic photosensitive member according to claim 1, wherein the conductive layer has a thickness of 0.5 to 9 μm.

4. An electrophotographic photosensitive member according to claim 3, wherein the conductive layer has a thickness of 0.5 to 4.5 μm.

5. An electrophotographic photosensitive member according to claim 1, wherein the binder resin contained in the conductive layer is a hardening resin, and the conductive layer contains resin particles in an amount of 20 to 35% by weight with respect to the hardening resin.

6. A process cartridge comprising and integrally supporting an electrophotographic photosensitive member according to claim 1, and at least one selected from the group consisting of charging means for charging a surface of the electrophotographic photosensitive member, developing means for developing an electrostatic latent image on a surface of the electrophotographic photosensitive member with a toner to form a toner image, transfer means for transferring the toner image on the surface of the electrophotographic photosensitive member onto a transfer material, and cleaning means for cleaning a toner remaining on the surface of the electrophotographic photosensitive member after the transfer of the toner image;

wherein the process cartridge is detachably mountable on a main body of an electrophotographic apparatus.

7. An electrophotographic apparatus comprising an electrophotographic photosensitive member according to claim 1, charging means for charging a surface of the electrophotographic photosensitive member, exposure means for forming an electrostatic latent image by an exposure on the surface, charged by the charging means, of the electrophotographic photosensitive member, developing means for developing the electrostatic latent image, formed by the exposure means on the surface of the electrophotographic photosensitive member, with a toner to form a toner image, and transfer means for transferring the toner image formed by the developing means on the surface of the electrophotographic photosensitive member onto a transfer material.

8. An electrophotographic apparatus according to claim 7, not including charge pre-elimination means for executing a charge elimination on the surface of the electrophotographic photosensitive member, after a transfer by the transfer means and before a charging by the charging means.

9. An electrophotographic apparatus according to claim 7, wherein the exposure means is a means for forming an electrostatic latent image by a laser exposure on the surface of the electrophotographic photosensitive member.

10. An electrophotographic photosensitive member comprising a conductive layer, an intermediate layer and a photosensitive layer in this order on a substrate, in which the conductive layer contains a binder resin and conductive particles, wherein:

the conductive particles are $TiO_2$ particles coated with oxygen-deficient $SnO_2$ with the proviso that $TiO_2$ particles coated with antimony-doped $SnO_2$ are excluded from the conductive particles;

the conductive particles have an average particle size of 0.2 to 0.6 μm;

the conductive layer has a volume resistivity of $5\times10^5$ to $8\times10^8$ Ω·cm; and an average particle size (D [μm]) of the conductive particles, and a weight ratio (P/B) of the conductive particles (P) and the binder resin (B) in the conductive layer, satisfy a following relation (1):

$$0.01\times(P/B)+0.28\leqq D\leqq 0.14\times(P/B) \quad (1).$$

* * * * *